US005807178A

United States Patent [19]

Todokoro

[11] Patent Number: 5,807,178

[45] Date of Patent: Sep. 15, 1998

[54] HORSE RACE GAME INSTRUMENT

[75] Inventor: Masatoshi Todokoro, Matsudo, Japan

[73] Assignee: Staff Co., Ltd., Tokyo-To, Japan

[21] Appl. No.: 818,885

[22] Filed: Mar. 17, 1997

[30] Foreign Application Priority Data

Jun. 7, 1996 [JP] Japan ..... 8-006690 U

[51] Int. Cl.[6] ..... A63H 18/10

[52] U.S. Cl. ..... 463/61; 463/68

[58] Field of Search ..... 463/61, 68

[56] References Cited

U.S. PATENT DOCUMENTS 1,867,237 7/1932 Vinson ..... 463/68 X 2,555,785 6/1951 Cook ..... 463/68

*Primary Examiner*—William H. Grieb

*Attorney, Agent, or Firm*—Oblon, Spivak, McClelland, Maier & Neustadt, P.C.

[57] ABSTRACT

A horse race game instrument which utilizes a simple running mechanism enabling running bodies to move and with which a horse race game can be enjoyably played on a table. A plurality of running bodies with a dummy of a horse or the like fit thereto being caused to move at different speeds on an oval-shaped running track formed in the top surface of a board body, a plurality of planar oval-shaped grooves are provided along the bottom of the running track, an endless belt is movably disposed in each of the grooves, a magnet is provided to an upper part of each of the running belts in order to move the running bodies by attraction, and a drive motor is provided under each of the running belts in order to move each of the running belts around along each of the grooves.

16 Claims, 2 Drawing Sheets

HORSE RACE GAME INSTRUMENT

BACKGROUND OF THE INVENTION (1) Field of the Invention

This invention relates to a horse race game instrument for enjoying playing a horse race game on a table.

(2) Description of the Prior Art

As prior art horse race game instruments for enjoying playing horse race games, large-sized game devices to be installed in video arcades or the like are generally known, and one example is described in an official gazette, JP. Provisional Patent Publication No. 4-75680, wherein a running table for placing running bodies thereupon is provided in a board body formed to contain a hollow space, the running bodies are placed on the running table, and when a disk in the board body is moved around by a moving means, then the running bodies are led in the moving direction of the disk by mutual attraction between second magnets or third magnets and first magnets of the running bodies, the disk being equipped therein with freely movable small articles each having the second magnets and freely rotatable rotating articles each having the third magnets. On this occasion, the small articles can move freely in the disk and the rotating articles make rotating motion relative to the disk, and therefore the moving bodies can be moved in the sphere of the disk or in the rotating sphere of the rotating articles while changing their running course.

Further, when a guide member for limiting movement of the first magnets of the running bodies and of the small articles is additionally provided to the top of the hollow room in the disk, small articles attractedly attached to the top of the room cannot move freely relative to the disk and therefore the running bodies are caused to move around keeping almost the same position relative to the disk. Still further, when a rotation means comprizing contact members contacting with the side face of the disk and drive means for driving the contact members is additionally provided in the board body, the disk is forcibly rotated by the rotation means and the running bodies are also turned, and because this turn is accompanied by movement along the track, the running bodies move in a parabola-like curve in the movement direction, and thereby running courses or rankings of the running bodies are changed.

The aforesaid prior art horse race game instruments, however, have disadvantage that devices thereof are not fit for a mechanism of horse race game instruments to be used on a table, because the running mechanism becomes complicated and microcomputer control is required in order that running bodies are moved by causing small articles bearing second magnets to be freely movable while rotating articles bearing third magnets to make rotating motion, causing the devices to become large-scaled and expensive.

This invention was accomplished in view of the above problems and has an object to provide a horse race game instrument which utilizes simple running mechanism enabling running bodies to move and with which a horse race game can be enjoyably played on a table.

SUMMARY OF THE INVENTION

In a first mode of the invention, in order to achieve the aforementioned object, a horse race game instrument according to the present invention, wherein a plurality of running bodies with a dummy of a horse or the like fit thereto are caused to move at different speeds on an oval-shaped running track formed in the top surface of a board body, is characterized in that a plurality of planar oval-shaped grooves are provided along the bottom of the aforesaid running track, an endless belt is movably disposed in each of the aforesaid grooves, a magnet is provided to an upper part of each of the aforesaid running belts in order to move the aforesaid running bodies by attraction, and a drive motor is provided under each of the aforesaid running belts in order to move each of the running belts around along each of the aforesaid grooves.

In a second mode of the invention, the board body is characterized in that the inside thereof is provided with a control means for changing rotational speed of each of the plurality of drive motors to an arbitrary rotational speed.

In a third mode of the invention, the board body is characterized in that the inside thereof is provided with speed sense contacts for detecting speed of each of the running bodies and that speed and starting positions of the running bodies are respectively set by means of the speed sense contacts.

In a fourth mode of the invention, the running bodies are characterized by each having a bottom plate, a magnet disposed on the bottom plate for being attracted by the magnet of a running belt, and a power transmission tire for causing the dummy of a horse to swing back and forth.

DETAILED DESCRIPTION OF THE PREFERRED EMBODIMENTS

Figure 1:
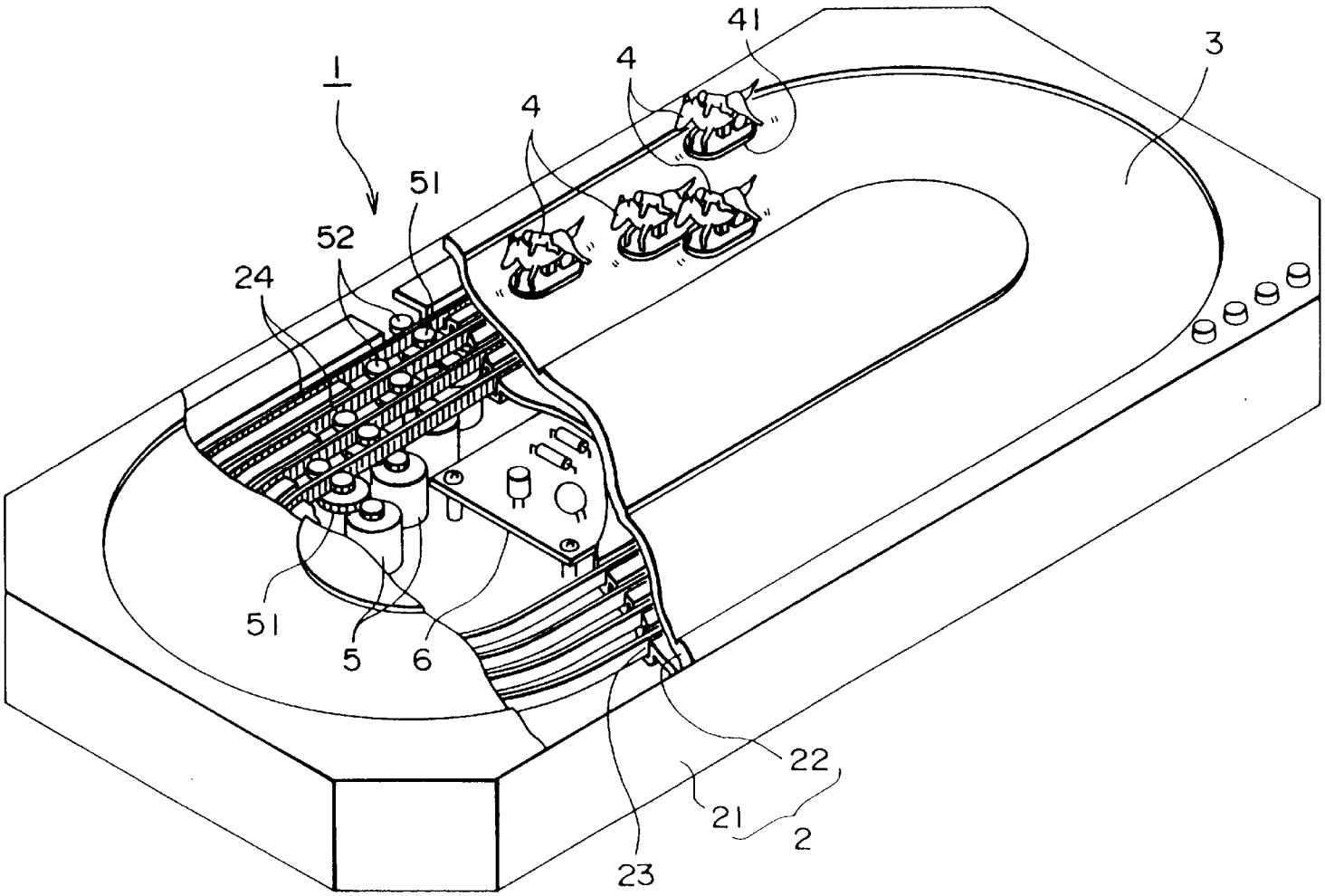
FIG. 1 is a perspective view illustrating an embodiment according to the present invention.

A preferred embodiment of the present invention is now described referring to the drawings.

In FIG. 1, the reference numeral 1 denotes a horse race game instrument. This horse race game instrument 1 is configured so that a running track 3 is formed in the top surface of a board body 2 and running bodies 4 are capable of running on this running track 3.

The board body 2 comprises a rectangular solid-like box-shaped frame body 21 and a running table 22 which covers the open top of the frame body 21 while four running grooves 23 are formed in concentric circles on the upper part of the frame body 21 along the bottom of the running track 3 of the running table 22. The running grooves 23 each have a predetermined depth while an endless belt 24 is disposed in, and moves around along, each of the running grooves 23. Each of the running belts 24 is moved around in the corresponding running groove 23 by a drive motor 5 disposed under each of the running belts 24.

The drive motors 5 being fixed to the inside of the board body 2, the rotary shaft of each of the drive motors 5 is equipped with a drive gear 51 which engages with inside teeth formed on the inside surface of each of the running belts 24, while a running belt pinch roller 52 is located, standing close by the corresponding drive gear 51, on the outside surface of each of the running belts 24, and power of each of the drive motors 5 can be securely transmitted to each of the running belts 24 by sandwiching each of the running belts 24 between each of the drive gears 51 and the corresponding running belt pinch roller 52.

Figure 2:
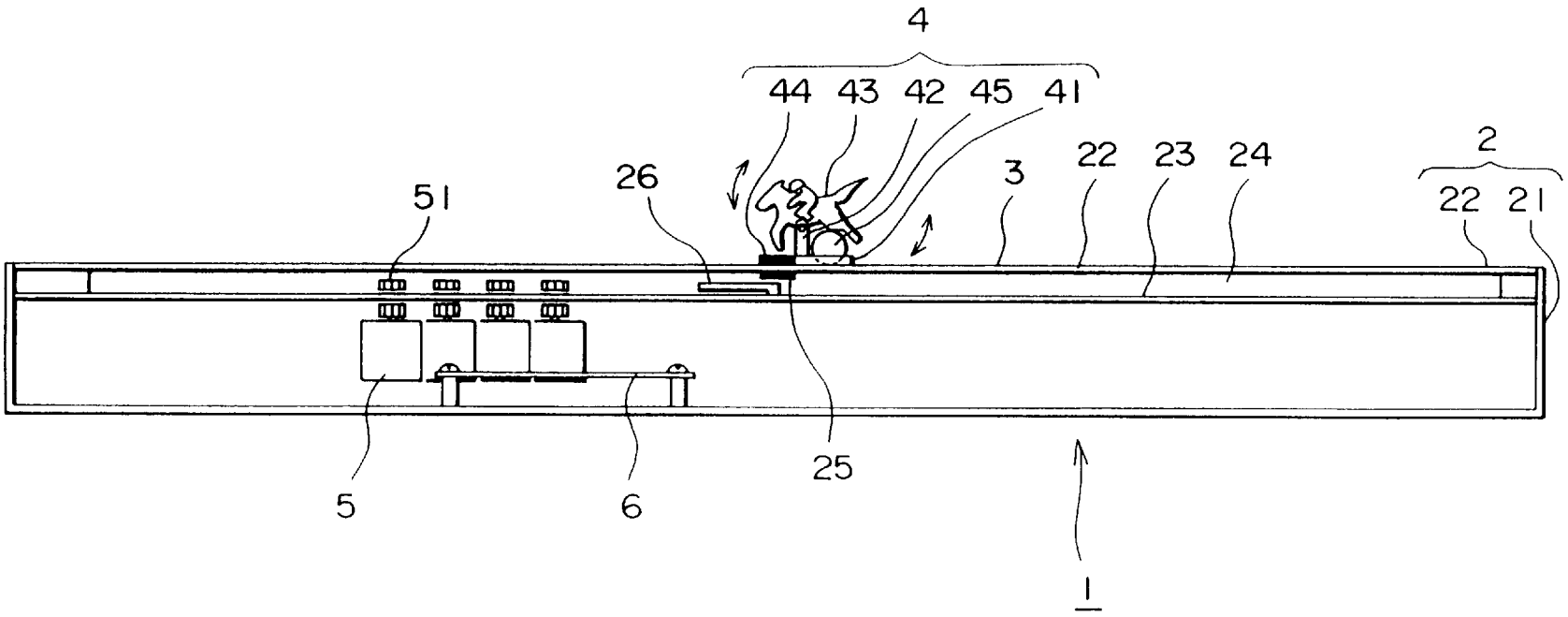
FIG. 2 is a partial vertical sectional view concerning FIG. 1.

As shown in FIG. 2, a magnet 25 is fixed to an upper part of each of the running belts 24 and moves along each of the running grooves 23 as each of the running belts 24 move around. Each of the running grooves 23 is equipped, on its bottom part, with a speed sense contact, one of 26A–26D for detecting moving speed of each of the magnets 25, which is aligned with a center line transversely bisecting the running track 3, and consequently moving speed of each of the running belts 24 is detected by each of the speed sense contacts 26A–26D, and along with this, speed of each of the running bodies 4 is adjusted by changing rotational speed of each of the drive motors 5 as one thinks fit. The board body 2 is equipped, on its central bottom part, with a control circuit board 6 for controlling rotational speed of each of the drive motors 5.

The running grooves 23, being covered with the running table 22 disposed on the top of the frame body 21, are situated under the running track 3.

Each of the running bodies 4 comprises a bottom plate 41, a support member 42 uprightly attached on the top of the bottom plate 41, a dummy of a horse 43 supported, freely swingably back and forth, by the support member 42, a magnet 44 fixed to the bottom plate 41 and attracted by the magnet 25 of a running belt 24, and a power transmission tire 45 which is rotated by the bottom plate 41 moving on the running track 3 and causes the dummy of a horse 43 to swing back and forth.

Accordingly, when a running body 4 is placed on the running track 3, the magnet 44 of the running body 4 is attracted by the magnet 25 of a running belt 24 via the running table 22, and in this state, if the running belt 24 is moved around along the corresponding running groove 23 by rotating the corresponding drive motor 5, the running body 4 is moved in the running track 3 by being attracted by the magnet 25.

Running speed of each of the running bodies 4 changes by changing rotational speed of the corresponding drive motor 5 as one thinks fit, and as a result, a horse racing game can be played enjoyably in which dummies of a horse run a nip and tuck race with one another on the running track. Further, it gives realism to a game that dummies of a horse make back and forth swinging motion while moving on the running track 3.

As described above, the present invention provides a horse race game instrument wherein a plurality of planar oval-shaped grooves are provided along the bottom of a running track, an endless belt is movably disposed in each of the grooves, a magnet is provided to an upper part of each of the running belts in order to move running bodies by attraction, and a drive motor is provided under each of the running belts in order to move each of the running belts around along each of the grooves, and a simple running mechanism enabling the running bodies to move is thus realized and therefore a horse race game can be played on a table.

According to the second mode of the present invention, a control means for changing rotational speed of each of the plurality of drive motors to an arbitrary rotational speed is provided inside of the board body, and therefore a complicated control with a microcomputer is no longer necessary.

According to the third mode of the present invention, speed sense contacts 26A–26D for detecting speed of each of the running bodies are provided inside of the board body and speed and starting positions of the running bodies are respectively set by means of the speed sense contacts, and therefore the speed control and starting positions can be reliably set.

According to the fourth mode of the present invention, each of the running bodies is provided with a bottom plate, a magnet disposed on the bottom plate for being attracted by the magnet of a running belt, and a power transmission tire for causing the dummy of a horse to swing back and forth, and therefore each of the running bodies is capable of moving, as each of the running belts runs, on the running track while causing the dummy of a horse to make back and forth swinging motion.

What is claimed is:

1. A horse race game instrument, wherein a plurality of running bodies each having a dummy figure fit thereto are caused to move at different speeds on an oval-shaped running track formed in a top surface of a board body, wherein a plurality of planar oval-shaped grooves are provided along a bottom of said running track, an endless belt is movably disposed in each of said grooves, a magnet is provided to an upper part of each of said endless belts in order to move said running bodies by attraction, and a drive motor is provided under each of said endless belts to transmit power directly to said endless belts in order to move each of said endless belts along each of said grooves.

2. The horse race game instrument according to claim 1, wherein an inside of said board body is provided with a control means for changing rotational speed of each of said drive motors to an arbitrary rotational speed.

3. The horse race game instrument according to claim 2, further comprising:

speed sense contacts provided on an inside of said board body for detecting speed of each of said running bodies and setting starting positions of said running bodies in accordance with respective positions of said speed sense contacts.

4. The horse race game instrument according to claim 3, wherein each of said running bodies has a bottom plate, a magnet disposed on a bottom plate for being attracted by a respective endless belt magnet, and a power transmission tire in contact with said top surface of said board body for causing said dummy figure to swing back and forth.

5. The horse race game instrument according to claim 2, wherein each of said running bodies has a bottom plate, a magnet disposed on a bottom plate for being attracted by a respective endless belt magnet, and a power transmission tire in contact with said top surface of said board body for causing said dummy figure to swing back and forth.

6. The horse race game instrument according to claim 1, further comprising:

speed sense contacts provided on an inside of said board body for detecting speed of each of said running bodies, and setting starting positions of said running bodies in accordance with respective positions of said speed sense contacts; and means for controlling rotational speed of said drive motors in a predetermined manner.

7. The horse race game instrument according to claim 3, wherein each of said running bodies has a bottom plate, a magnet disposed on a bottom plate for being attracted by a respective endless belt magnet, and a power transmission tire in contact with said top surface of said board body for causing said dummy figure to swing back and forth.

8. The horse race game instrument according to claim 1, wherein each of said running bodies has a bottom plate, a magnet disposed on a bottom plate for being attracted by a respective endless belt magnet, and a power transmission tire in contact with said top surface of said board body for causing said dummy figure to swing back and forth.

9. A race game instrument, comprising:

a board body having a top surface including an oval running track;

plural running bodies movable at different speeds on said oval running track;

a plurality of planar oval-shaped grooves provided along a bottom of said running track;

a respective endless belt movably disposed in each of said grooves;

a respective magnet provided on an upper part of each of said endless belts in order to move said running bodies by attraction; and a respective drive motor provided under each of said endless belts to transmit power directly to said endless belts in order to move each of said endless belts along each of said grooves.

10. The race game instrument according to claim 9, wherein an inside of said board body is provided with a control means for changing rotational speed of each of said drive motors to an arbitrary rotational speed.

11. The race game instrument according to claim 10, further comprising:

speed sense contacts provided on an inside of said board body for detecting speed of each of said running bodies and setting starting positions of said running bodies in accordance with respective positions of said speed sense contacts.

12. The race game instrument according to claim 11, wherein each of said running bodies has a bottom plate, a magnet disposed on a bottom plate for being attracted by a respective endless belt magnet, and a power transmission tire in contact with said top surface of said board body for causing a respective running body to swing back and forth.

13. The race game instrument according to claim 10, wherein each of said running bodies has a bottom plate, a magnet disposed on a bottom plate for being attracted by a respective endless belt magnet, and a power transmission tire in contact with said top surface of said board body for causing a respective running body to swing back and forth.

14. The race game instrument according to claim 9, further comprising:

speed sense contacts provided on an inside of said board body for detecting speed of each of said running bodies, and setting starting positions of said running bodies in accordance with respective positions of said speed sense contacts; and means for controlling rotational speed of said drive motors based on at least one of an operator input and said detected speed.

15. The race game instrument according to claim 14, wherein each of said running bodies has a bottom plate, a magnet disposed on a bottom plate for being attracted by a respective endless belt magnet, and a power transmission tire in contact with said top surface of said board body for causing a respective running body to swing back and forth.

16. The race game instrument according to claim 9, wherein each of said running bodies has a bottom plate, a magnet disposed on a bottom plate for being attracted by a respective endless belt magnet, and a power transmission tire in contact with said top surface of said board body for causing a respective running body to swing back and forth.

* * * * *